US007823875B2

(12) United States Patent
Fukatsu et al.

(10) Patent No.: US 7,823,875 B2
(45) Date of Patent: Nov. 2, 2010

(54) SHEET FEEDING DEVICE, AND IMAGE FORMING DEVICE

(75) Inventors: Yasuo Fukatsu, Abiko (JP); Tsuyoshi Moriyama, Toride (JP); Yuzo Matsumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 246 days.

(21) Appl. No.: 12/024,382

(22) Filed: Feb. 1, 2008

(65) Prior Publication Data

US 2008/0191406 A1 Aug. 14, 2008

(30) Foreign Application Priority Data

Feb. 9, 2007 (JP) ..... 2007-029893

(51) Int. Cl.
*B65H 1/18* (2006.01)

(52) U.S. Cl. ..... 271/153; 271/152; 271/98; 271/97; 271/147; 271/265.04

(58) Field of Classification Search ..... 271/97, 271/98, 90, 152, 153, 147, 265.04
See application file for complete search history.

(56) References Cited

U.S. PATENT DOCUMENTS 4,835,573 A * 5/1989 Rohrer et al. ..... 399/23
5,356,127 A * 10/1994 Moore et al. ..... 271/11
5,645,274 A * 7/1997 Ubayashi et al. ..... 271/94
5,839,015 A * 11/1998 Faguy et al. ..... 399/23
5,988,629 A * 11/1999 Burlew et al. ..... 271/152
6,698,747 B2 * 3/2004 Dobbertin et al. ..... 271/30.1
7,458,570 B2 * 12/2008 Ueda et al. ..... 271/97
7,575,231 B2 * 8/2009 Sasaki et al. ..... 271/98
2005/0040584 A1 2/2005 Isemura
2007/0228639 A1 10/2007 Matsumoto et al. ..... 271/97
2008/0036134 A1 2/2008 Matsumoto ..... 271/4.03

FOREIGN PATENT DOCUMENTS

JP 2005-96992 A 4/2005

* cited by examiner

*Primary Examiner*—Saúl J Rodriguez
*Assistant Examiner*—Luis Gonzalez
(74) *Attorney, Agent, or Firm*—Fitzpatrick, Cella, Harper & Scinto

(57) ABSTRACT

There is provided a sheet feeding device in which a sheet is discriminated at preliminary loosening before feeding, and is set to be controlled according to the type of the sheet by a simple configuration without requiring a special configuration. In the sheet feeding device in which air is blown onto a sheet stack, and a sheet floating at the uppermost level by the blowing is absorbed and conveyed, a sheet type is discriminated, based on a moving amount of the tray, at preliminary loosening before sheet feeding after setting the sheet in a tray.

6 Claims, 20 Drawing Sheets

*FIG.13*

TRAY MOVING AMOUNTS FOR EACH OF SEPARATING FAN DRIVE PWMs

| | THIN PAPER | PLAIN PAPER | THICK PAPER | THICKEST PAPER |
|---|---|---|---|---|
| SEPARATING FAN DRIVE PWM100% | 10mm | 8mm | 5mm | 2mm |
| SEPARATING FAN DRIVE PWM75% | 7.5mm | 6mm | 2.5mm | - |
| SEPARATING FAN DRIVE PWM50% | 5mm | 3.5mm | - | - |
| SEPARATING FAN DRIVE PWM25% | 2.5mm | 1mm | - | - |

SHEET FEEDING DEVICE, AND IMAGE FORMING DEVICE

BACKGROUND OF THE INVENTION

1. Field of the Invention

The present invention relates to a sheet feeding device which feeds sheets one by one from a storage storing a plurality of sheets, or an image forming device such as a printer and a copying machine, which are provided with the sheet feeding device.

2. Description of the Related Art

Conventionally, various types of sheet feeding devices have been proposed for use in an image forming device such as a printer and a copying machine, wherein the sheet feeding device separately feeds sheets one by one. Among the proposed feeding devices, there has been proposed a sheet feeding device using a so-called air separation method, according to which a plurality of sheets are floated for loosening by blowing air to the upper side end portion of a sheet stack, and a loosened sheet at the uppermost position is absorbed and conveyed on an absorption conveying belt. As various types of sheets may be surely and separately conveyed at high speed by the sheet feeding devices using the air separation method, higher demand for the sheet feeding devices has been caused in a print on demand (POD) field in which a large quantity of printing, simple bookbinding, and the like are performed, using an image forming device based on an electrophotographic method.

Among sheet feeding mechanisms using the air separation method, a technique has been disclosed in Japanese Patent Application Laid-Open No. 2005-96992, wherein, according to the technique, a type of a sheet is set, and air flow volume (air flow velocity) of a fan executing loosening operation is changed according to the type of the set sheet.

A sheet may be separately conveyed in a more sure manner by loosening a sheet at an optimum air flow volume (air flow velocity) according to the type of a set sheet as described above.

However, when copying, and printing is performed, using the image forming device, a user is required to set a sheet type. Thereby, when input miss, or input omission is caused at input of a sheet type by the user, there is a possibility that a sheet may not be separately conveyed in a secure manner.

SUMMARY OF THE INVENTION

An object of the present invention is to provide a sheet feeding device in which a sheet type is automatically discriminated by a simple configuration, and air blowing may be controlled according to the types of sheets.

The present invention is a sheet feeding device, having: a tray which may be moved upward and downward in a state in which a plurality of sheets are stacked; an air blowing unit which blows air onto a sheet stacked in the tray for floating and loosening; an absorption conveying unit which absorbs and conveys a uppermost sheet of the sheets stacked on the tray floated by blowing air blown by the air blowing unit at a feed position; a sheet detection portion which detects a position of the uppermost sheet floated by blowing of the air blowing unit; a tray moving unit which moves the tray upward and downward; and a tray moving amount detection portion which detects a tray moving amount caused by the tray moving unit, wherein the tray is moved by the tray moving unit in such a way that the uppermost sheet floated by blowing air is moved to the feed position based on detection of the sheet detection portion, and a sheet type of the sheets on the tray is discriminated based on the moving amount of the tray detected by the tray moving amount detection portion.

In the present invention, a type of a stored sheet may be detected, based on a moving amount of a tray, when sheets are loosened by blowing air. Thereby, optimum loosening control may be performed according to the type of a sheet at sheet feeding, and a sheet may be conveyed in a secure manner.

Further features of the present invention will become apparent from the following description of exemplary embodiments (with reference to the attached drawings).

BRIEF DESCRIPTION OF THE DRAWINGS

FIG. 13 is a table of tray moving amounts for each of separating fan drive PWMs;

DESCRIPTION OF THE EMBODIMENTS

Subsequently, an image forming device will be described, referring to drawings, wherein the device is provided with a sheet feeding device according to one embodiment of the present invention.

[General Configuration of an Image Forming Device]

Figure 1:
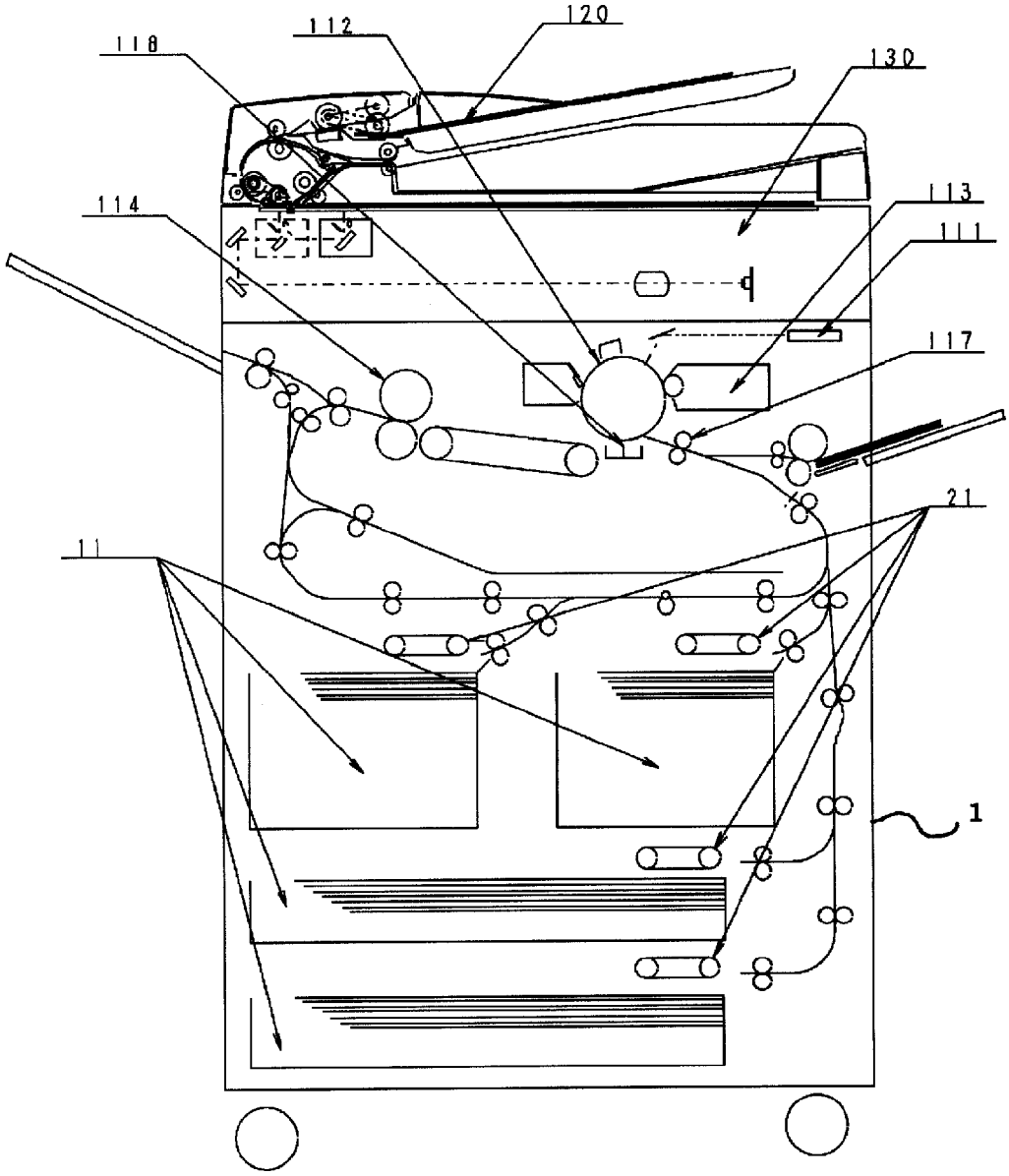
FIG. 1 is a schematic cross section of an image forming device provided with a sheet feeding device according to an embodiment.

FIG. 1 is a schematic cross section of an image forming device 1 provided with a sheet feeding device according to a first embodiment.

Schematic description of a general configuration of the image forming device 1 will be made, based on image forming operation. In the first place, a document is automatically sent to a reading position by an auto document feeding portion 120, and image information is read in an image reading portion 130. The read image information is processed by a not-illustrated controller, and an image is recorded on a sheet by an image forming portion according to signals based on a processed result.

That is, laser light is emitted from a laser scanner unit 111 according to the read signal, and an electrostatic latent image is formed on a photosensitive drum 112. The electrostatic latent image on the photosensitive drum is developed by a development device 113. On the other hand, a sheet such as paper and an OHT stored in a storage 11 is fed by a feeding device provided with an absorption conveying belt 21, and the like, and is put into a synchronized state with a toner image on the photosensitive drum 112 in a resist portion 117 for transfer in a transfer portion 118. Furthermore, the sheet is led to a pair of fixing rollers 114, is heated, is pressed, and is discharged to the outside the device after permanent fixing.

[Sheet Feeding Device]

Subsequently, a configuration of the sheet feeding device will be described, wherein the device is provided for feeding by which sheets stored in the storage 11 are separately conveyed one by one.

Figure 2:
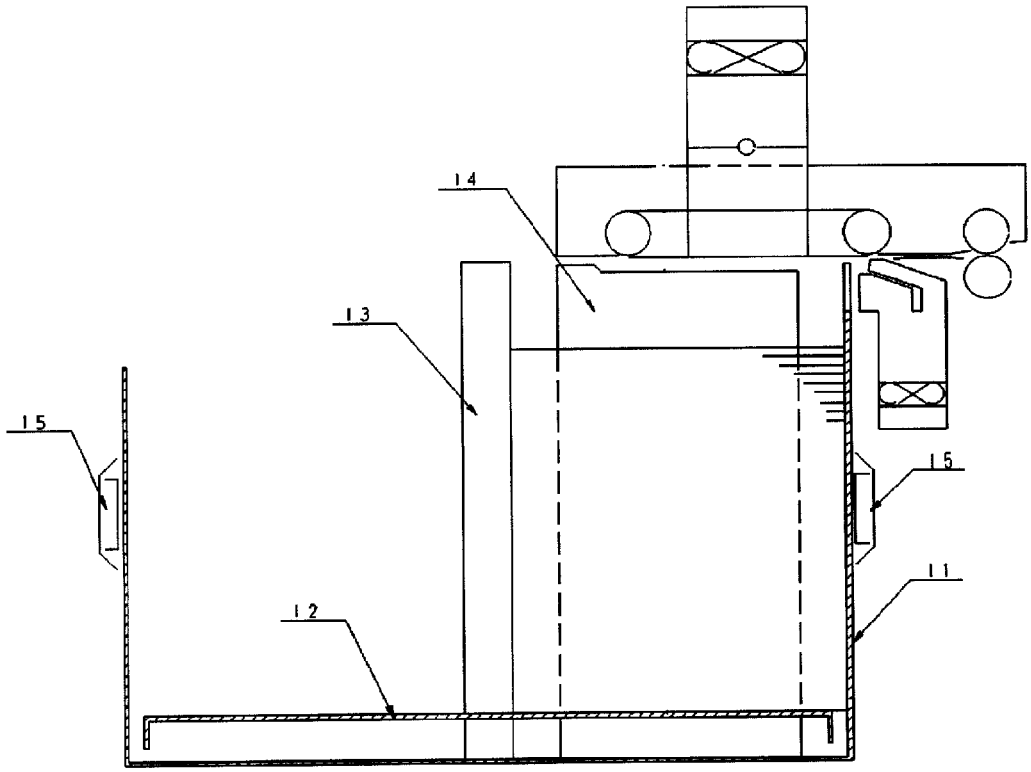
FIG. 2 is a view describing a storage.

In the main body of the device, there is provided the storage 11, in which a plurality of sheets may be stored, as illustrated in FIG. 2. In the storage 11, there are provided a tray 12 in which sheets are stacked, a rear end regulating plate 13 which regulates the rear end of a sheet stacked on the tray 12 on the upstream side in the conveying direction, and a side regulating plate 14 which regulates the side end of a sheet in the width direction perpendicular to the conveying direction. Moreover, a slide rail 15 is provided between the storage 11 and the main body of the device, and enables the storage 11 to be drawn out from the device main body.

The position of the rear end regulating plate 13 and that of the side restriction board 14 are configured to arbitrarily be changed according to the size of a sheet.

Figure 3:
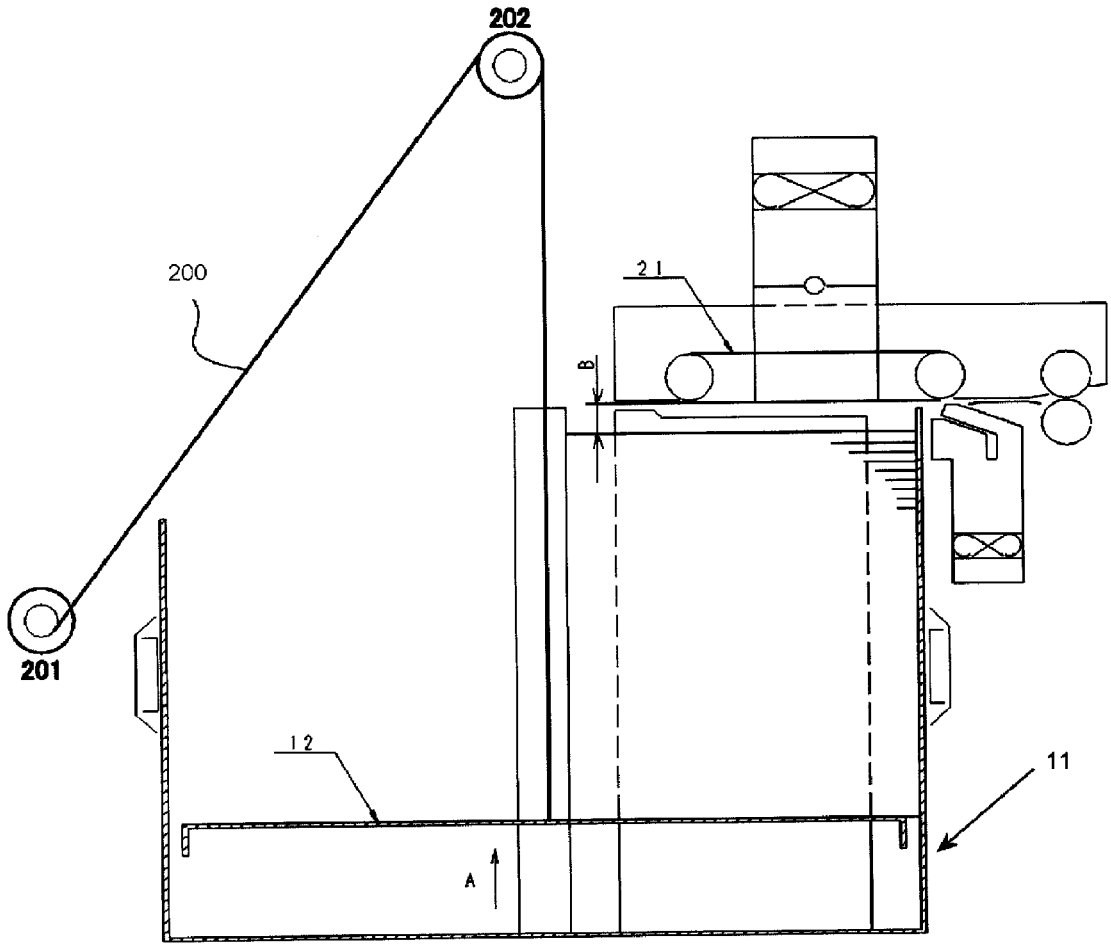
FIG. 3 is a view describing a configuration in which a storage is moved.

The tray 12 may be vertically moved by a tray moving unit. The tray moving unit has a configuration, as illustrated in FIG. 3, in which wire 200 is carried on the periphery of a pulley 202, one end of the wire 200 is connected to the tray 11, and the other one is connected to a tray moving motor 201. Then, the tray 11 is moved upward and downward by winding up or winding back the wire 200 according to the rotation direction of the tray moving motor 201.

In FIG. 3, when a user draws out the storage 11, sets sheets in the tray 11, and stores the storage 11 at a predetermined position again, the tray 12 is moved upward in the direction of A illustrated in the drawing through the pulley 202 by driving of the tray moving motor 201. Moreover, the tray 12 is stopped at a position, at which a distance between the uppermost position of the set sheet stack and the absorption conveying belt 21 is B, and is prepared for a feed signal by which feeding of a sheet is started.

Figure 4:
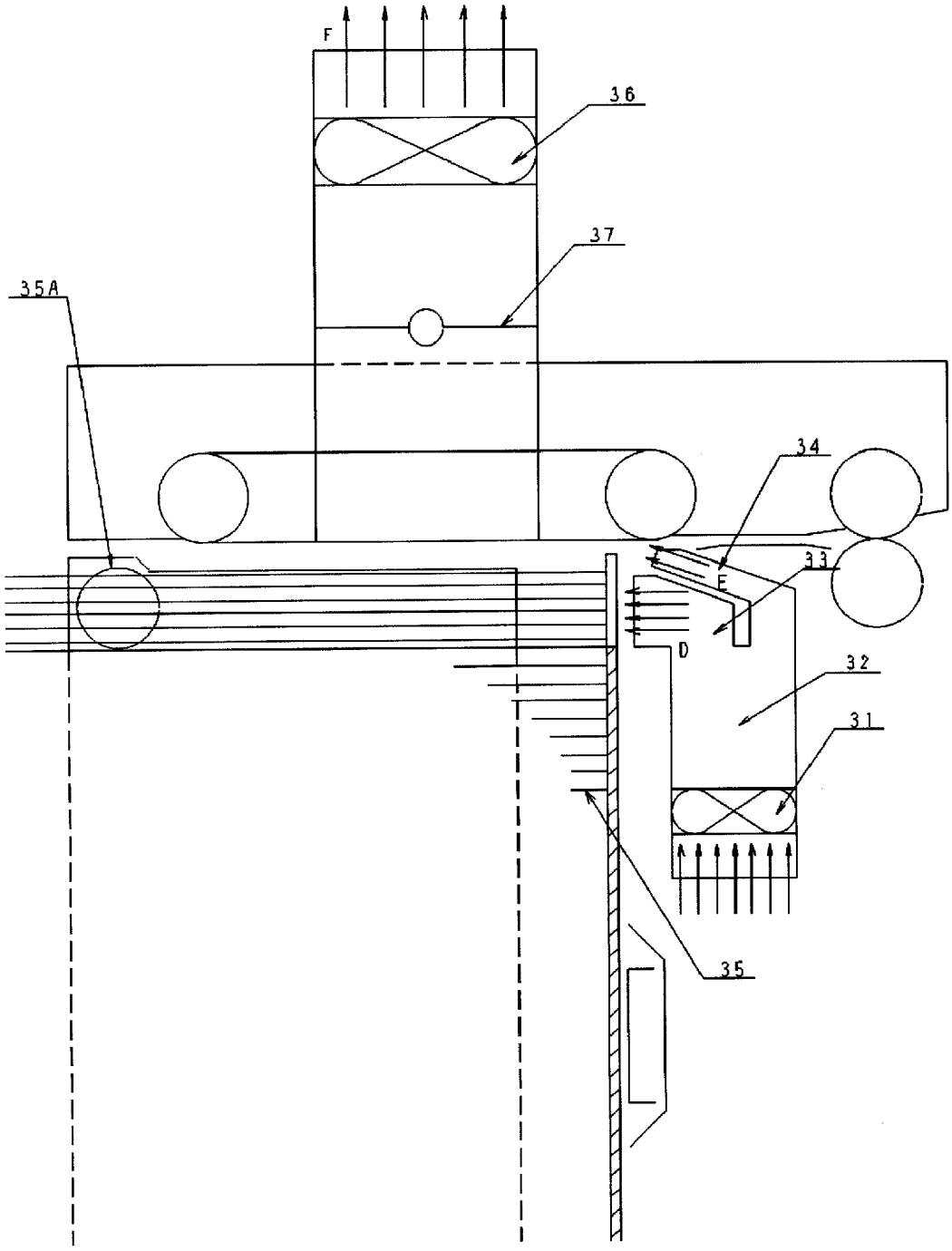
FIG. 4 is a view describing a configuration in which a sheet is separately conveyed by blowing air to sheets and by loosening them.

An air blowing unit, by which air is blown and a sheet is loosened, is provided at the upper portion of a sheet stack set in the tray 12. As illustrated in FIG. 4, the air blowing unit is provided with a separating fan 31, a loosening nozzle 33 and a separation nozzle 34. Air blown out from the separating fan 31 is sent to the nozzle 33, and the separation nozzle 34 through a separation duct 32. The loosening nozzle 33 loosens a sheet by blowing air from the side at the upper portion of the sheet stack, and the separation nozzle 34 blows out air in order to separate a sheet absorbed on the after-described absorption conveying belt 21 from other sheets by air blowing. When the image forming device receives a feed signal in FIG. 4, the separating fan 31 is operated to suck in air in the direction to C illustrated in the drawing. The air is blown onto the sheet stack from the loosening nozzle 33 from the direction of D illustrated in the drawing through the separation duct 32, and is blown thereto from the separation nozzle 34 from the direction of E illustrated in the drawing through the duct 32. Then, upper several pieces (35A), among the sheet stack 35, are floated as illustrated in FIG. 4.

Figure 5:
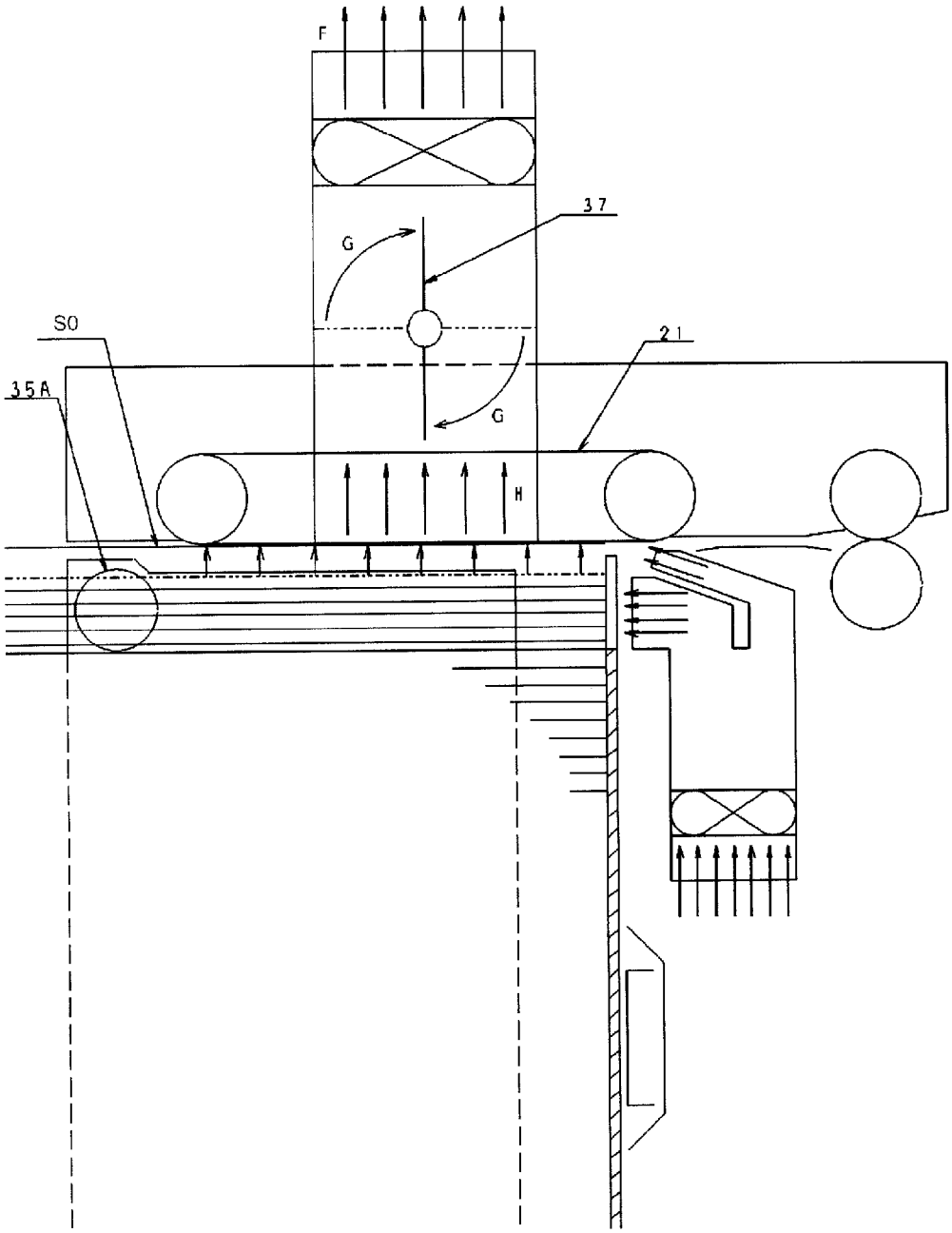
FIG. 5 is a view describing a configuration in which a sheet is separately conveyed by blowing air to sheets and by loosening the sheets.

The sheet feeding device is provided with an absorption conveying unit by which a sheet at the uppermost level, among sheets floated by the air sprayed by the air blowing unit, is sent toward the image forming portion. As illustrated in FIG. 5, the absorption conveying unit has: the absorption conveying belt 21; and an absorption fan 36 generating negative pressure through not-illustrated suck holes formed on the absorption conveying belt 21, wherein a sheet is absorbed by the negative pressure. Moreover, an absorption shutter 37 is provided in a duct between the absorption conveying belt 21 and the absorption fan 36. Then, the absorption shutter 37 is rotated in the direction of G in the drawing to open the duct from the closed state in FIG. 5, when predetermined time has passed since the feed signal was received, sheets 35A in the upper portion are stably floated, and the sheets 35A are fully loosened. Thereby, the pressure in the duct becomes negative, suction force in the direction of H illustrated in the drawing is generated from the not-illustrated suck holes opened in the absorption conveying belt 21, and one sheet S0 at the uppermost level is absorbed by the absorption conveying belt 21.

Figure 6:
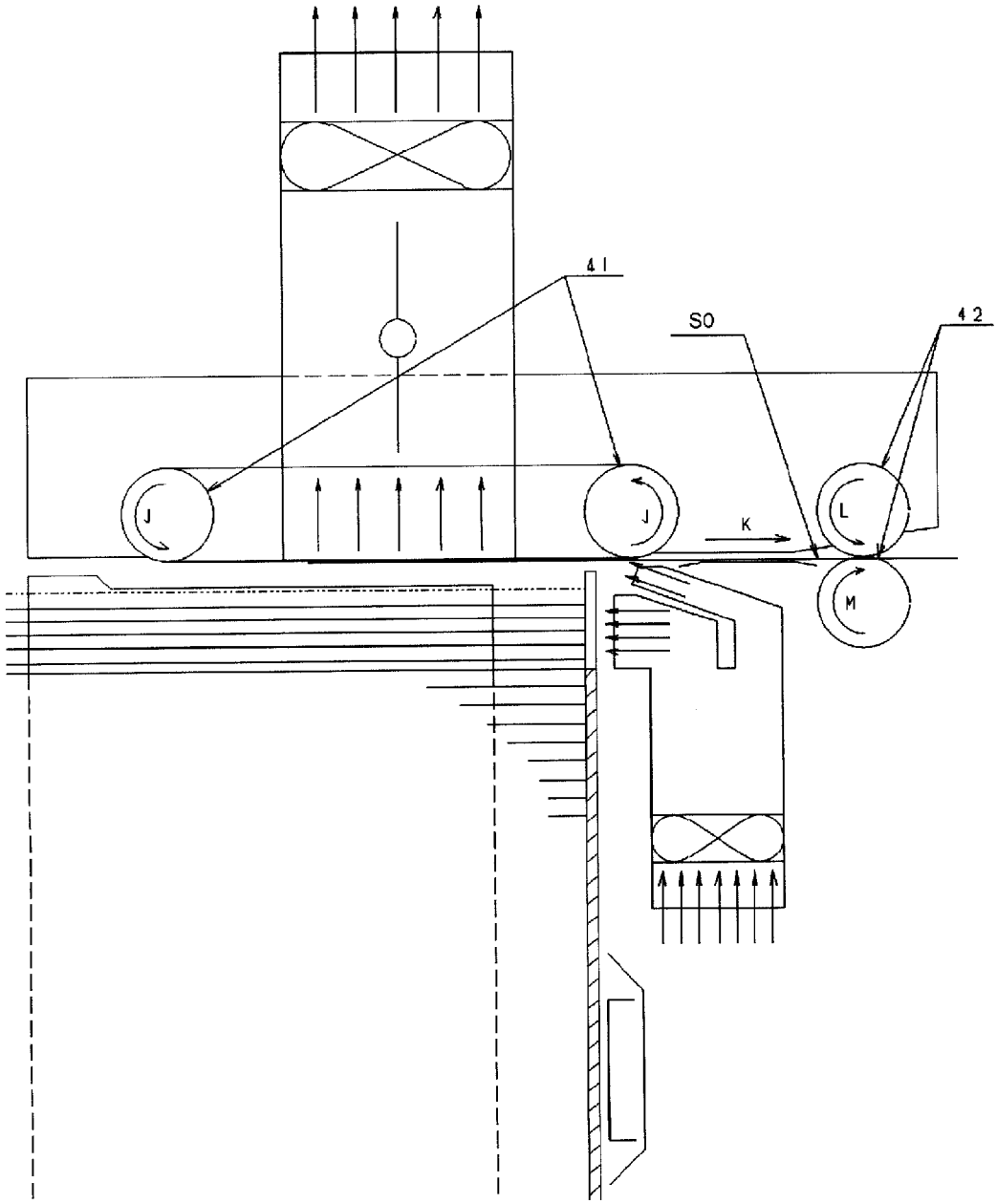
FIG. 6 is a view describing a configuration in which a sheet is separately conveyed by blowing air to sheets and by loosening the sheets.

In FIG. 6, the sheet S0 at the uppermost level is conveyed in the direction of K in the drawing in a state in which the sheet S0 is absorbed on the absorption conveying belt 21 by rotating a belt drive roller 41 rotating the absorption conveying belt 21 in the direction of J in the drawing. Then, the sheet is passed to a pair of pulling-out rollers 42, and the sheet is sent to the subsequent conveying path by rotating the pair of pulling-out rollers 42 in the directions of L and M, respectively, wherein the rollers 42 are provided on the downstream side in the sheet conveying direction.

[Control Portion]

Figure 7:
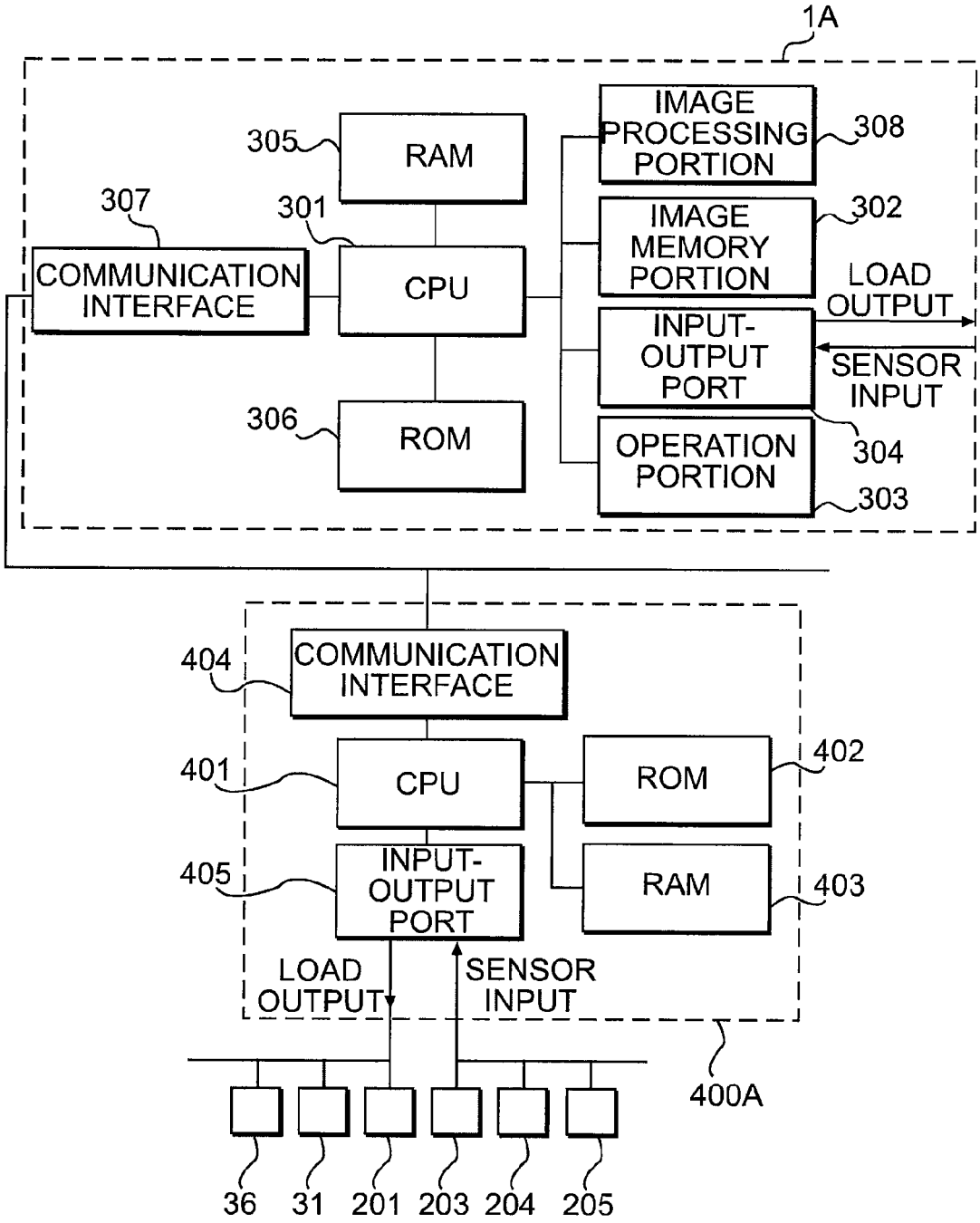
FIG. 7 is a block diagram illustrating a configuration of a control portion in a main body of an image forming device, and that in a sheet deck.

FIG. 7 is a block diagram illustrating a configuration of a control portion 1A, and a configuration of a control portion 400A in the storage 11, wherein the portion 1A and the storage 11 are included in the image forming device 1 illustrated in FIG. 1. The control portion 1A in the main body of the image forming device 1 includes: a CPU 301; a ROM 306; a RAM 305; a communication interface (I/F) 307; an input-output port 304; an operation portion 303; an image processing portion 308; and an image memory portion 302.

The CPU 301 basically controls the main body of the image forming device 1, and is connected to the ROM 306 in which control programs are written, the work RAM 305 by which processing is executed, and the input-output port 304 through address buses and data buses. A part of regions in the RAM 305 are backup RAMs from which data is not deleted even when the power supply is turned off. Various kinds of load devices such as motors and clutches, which are controlled by the main body of the image forming device 1, and input devices such as sensors which detect a position of a sheet are connected to the input-output port 304.

In order to process image forming, the CPU 301 sequentially controls inputs and outputs through the input-output port 304 according to the contents of control programs stored in the ROM 306. Moreover, an operation portion 500A is connected to the CPU 301 which controls a display portion, and a key input portion in the operation portion 500A.

A user instructs the CPU 301 through key input to switch image forming operation modes and displays, and the CPU 301 displays operation states of the main body of the image forming device 1, and operation modes set by the key input on an U display portion in the operation portion 500A. Furthermore, the image processing portion 308, and the image memory portion 302 storing processed images are connected to the CPU 301.

Here, the control portion 400A in the storage 11 includes: a CPU 401; a ROM 402; a RAM 403; a communication interface (I/F) 404, and an input-output port 405 in order to realize operations described by use of FIG. 2 through FIG. 6. The CPU 401 outputs drive instructions through the input-output port 40 to a sheet floating lower limit sensor 203, a sheet floating upper limit sensor 204, a tray moving motor FG sensor 205, the tray moving motor 201, the separating fan 31, and the absorption fan 36, wherein the port 40, and the sensors 203 through 205 will be described later.

Figure 8:
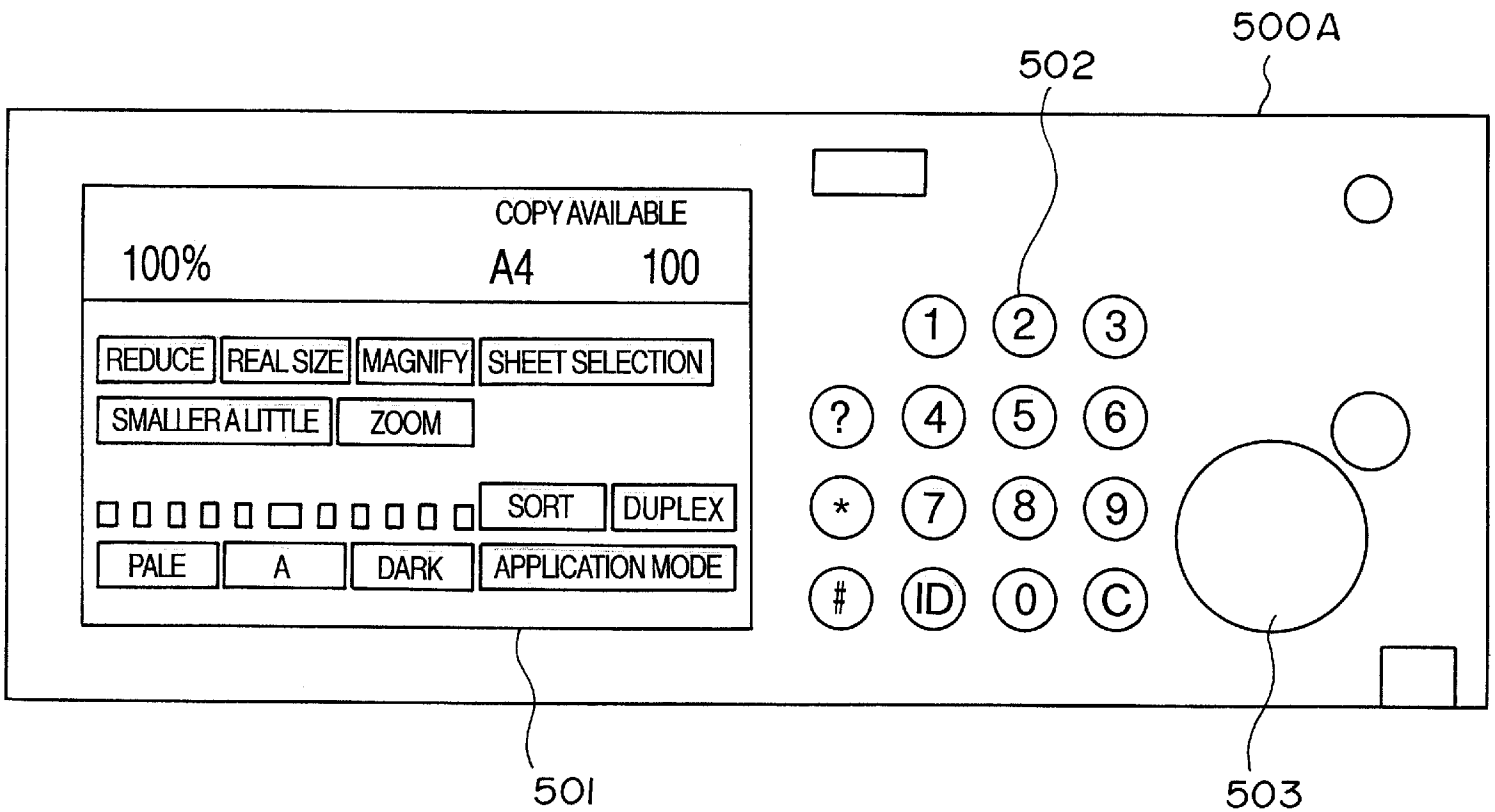
FIG. 8 is a schematic view illustrating a configuration of an operation portion in the image forming device.

FIG. 8 is a schematic view illustrating a configuration of an operation portion 500A in the image forming device according to the present embodiment.

In the drawing, a display portion 501 is a display portion on which various kinds of messages, work procedures, and the like are displayed, wherein the messages are provided for indicating operation states of devices, work instructions to a user, and the like. Moreover, a touch panel is provided on the surface of the display portion 501, and functions as a selection key by touching the surface. Ten keys 502 are keys through which numbers are input. Copy operation is started by pushing a start key 503.

Figure 9:
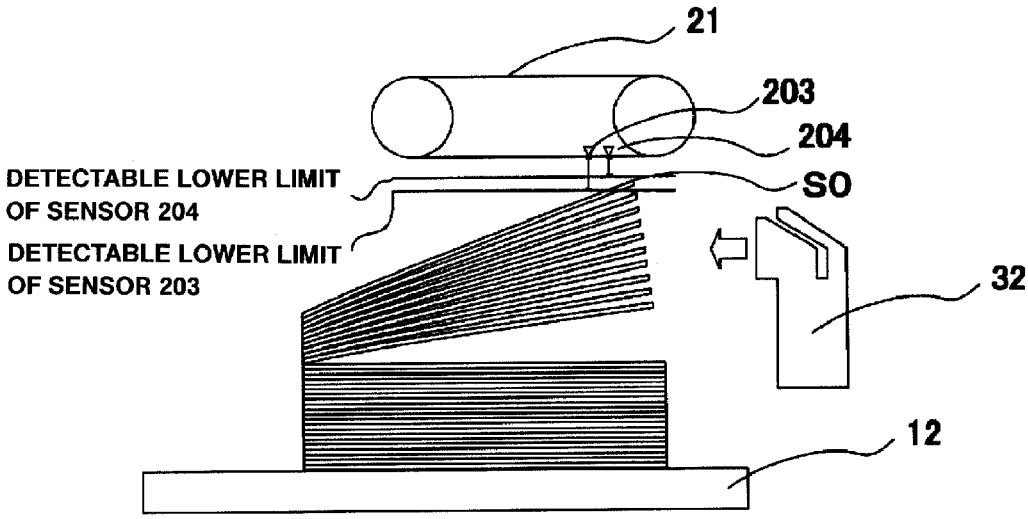
FIG. 9 is a view describing an optimum position of a sheet at the uppermost level.

Subsequently, a configuration of the sheet detection portion will be described, using FIG. 9, wherein the sheet detection portion detects a sheet S0 at the uppermost level among sheets on the tray 12 among sheets loosened by the separating fan 31 through the separation duct 32.

In the absorption conveying belt 21, there are a sheet floating lower limit sensor including an optical sensor 203 (hereinafter, only called "lower limit sensor"), and a sheet floating upper limit sensor including an optical sensor 204 (hereinafter, only called "upper limit sensor"). The lower limit sensor 203, and the lower limit sensor 204 are sensors which detect a position of a sheet floated by the wind pressure of the separating fan 31. The lower limit sensor 203 is provided for defining a lower limit position of the uppermost sheet among sheets floated by blown air, and the upper limit sensor 204 is provided for defining an upper limit position of the uppermost sheet among sheets floated by blown air. It is configured to detect, using the lower limit sensor 203 and the upper limit sensor 204, whether a floated sheet at the uppermost level is located between the upper limit position and the lower limit position. That is, if the sheet at the uppermost level is within a detection range limited by the lower limit sensor 203 and the upper limit sensor 204, it is possible to convey the sheet at the uppermost level in a state in which the sheet at the uppermost level is absorbed by the absorption conveying belt 21. Positions within the detection range is assumed to be a feed position (range) at which the sheet at the uppermost level may be fed.

In the present embodiment, there is provided a tray moving amount detection portion detecting a moving amount of the tray 12 in order to feed a sheet, which is at the uppermost level, at an optimum height. The tray moving amount detection portion in the present embodiment is configured to detect the moving amount by detecting the rotation amount of the moving motor 201, using an encoder as illustrated in FIG. 10, wherein the motor 201 is a driving source to move the tray 12.

Figure 10:
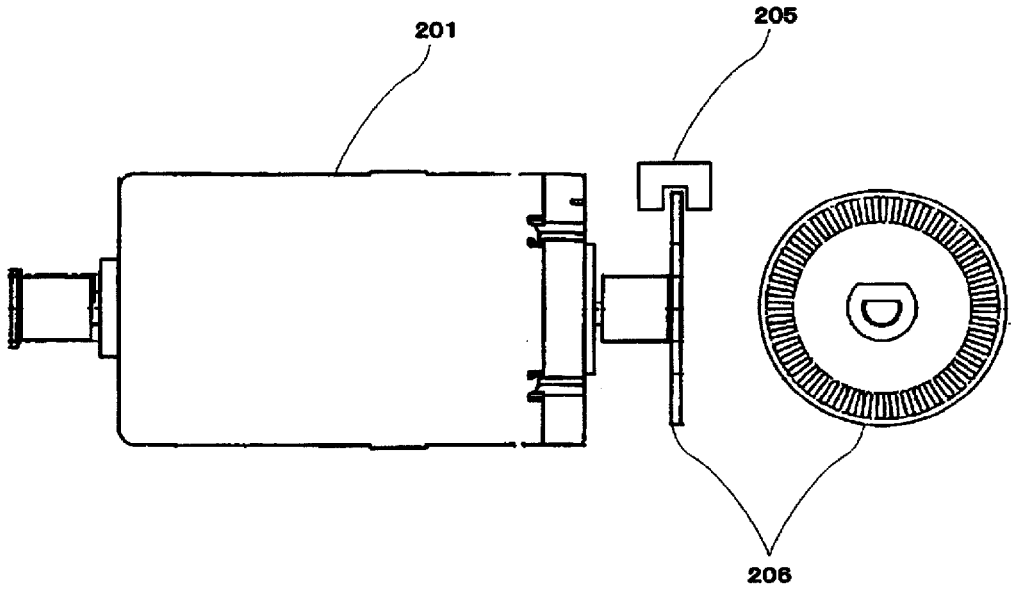
FIG. 10 is a view describing a configuration of a tray moving motor.

FIG. 10 is a view describing a cross section of the tray moving motor 201 connected to the tray 12 through the pulley 202 (FIG. 2), and, at the same time, an encoder 206 rotating integrally with the output axis of the motor, and the tray moving motor FG sensor 205 detecting the output of the encoder 206 are illustrated therein.

When the tray moving motor 201 is rotated, a signal (clock) is output from the tray moving motor FG sensor 205 according to the rotation. Here, as the moving amount of the tray 12 per one clock is a predetermined value, the total moving amount of the tray 12 may be calculated by measuring an output clock.

[Discrimination of Sheet Type]

Subsequently, using FIG. 11 through FIG. 13, there will be described a method by which a type of a sheet is detected, based on a moving amount of the tray 12.

Figure 11A:
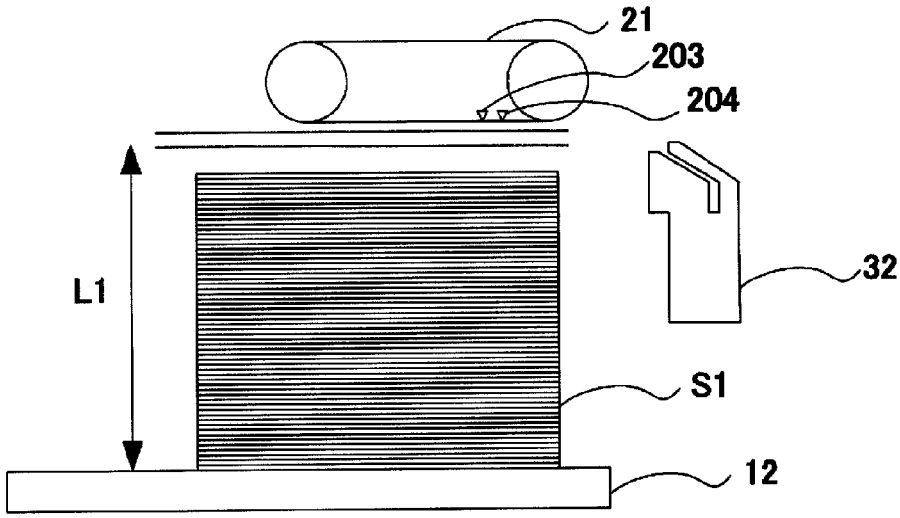
FIG. 11A is a view describing a method by which the type of a sheet is detected, using a tray moving amount.

When a user draws out the storage 11, sets sheets, and stores the storage 11 at a predetermined position again, the tray 12 is moved upward by driving the tray moving motor 201, and is stopped at the predetermined position as illustrated in FIG. 11A. The stopping position is located at a position at a predetermined distance from the detectable lower limit of the lower limit sensor 203, and, in the present case, the position of the tray 12 is at a distance of L1 from the detectable lower limit of the lower limit sensor 203.

Figure 11B:
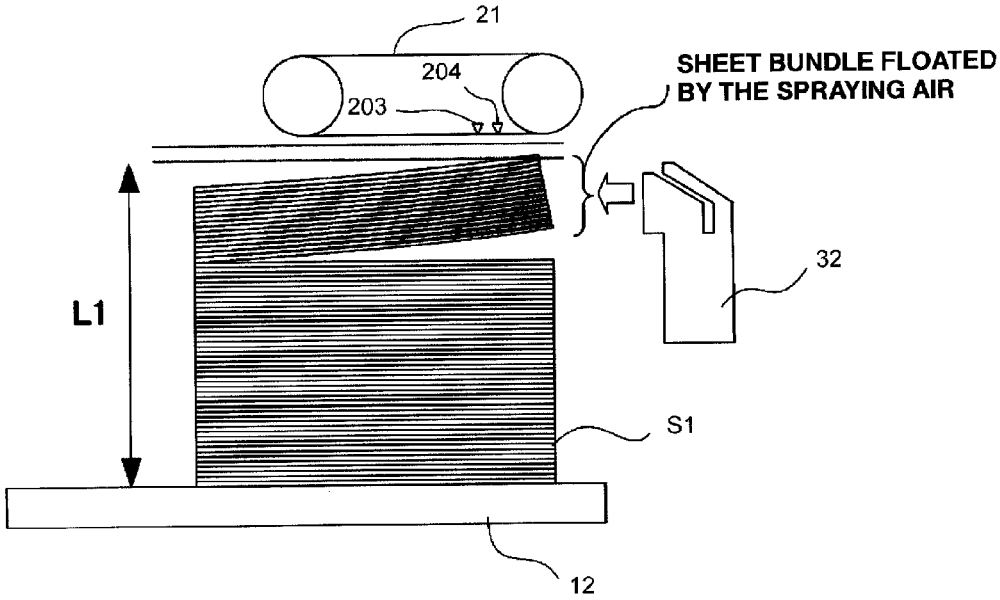
FIG. 11B is a view describing a method by which the type of a sheet is detected, based on a tray moving amount.

When air is blown from the separating fan 31 through the separation duct 32 in this state, the upper portion of the sheet stack is floated as illustrated in FIG. 11B. As sheets are closely contacted with each other in the floated sheet stack, the sheet at the uppermost level is blown upwards from the detectable upper limit of the upper limit sensor 204 beyond the detection range defined by the lower limit sensor 203 and the upper limit sensor 204. Then, the tray 12 is moved downward because the sheet at the uppermost level is required to be returned to within the detection range (feed position) defined by the lower limit sensor 203 and the upper limit sensor 204.

Figure 11C:
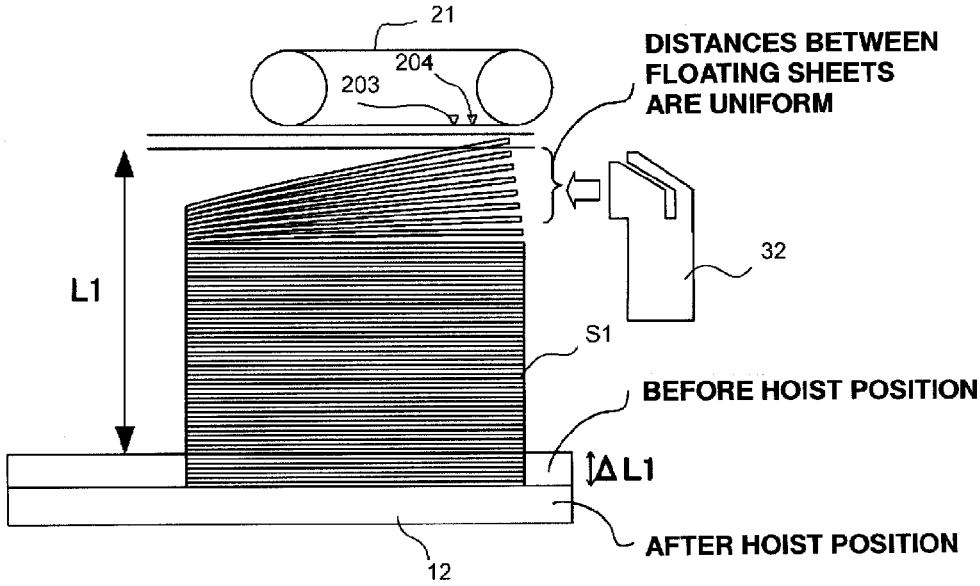
FIG. 11C is a view describing a method by which a type of a sheet is detected, based on a tray moving amount.

Then, there is easily caused an air layer between sheets by movement downward of the tray 12 as illustrated in FIG. 11C, and distances between floating sheets become approximately uniform. When the sheet at the uppermost level exists within the detection range (feed position) defined by the lower limit sensor 203 and the upper limit sensor 204, the sheet may be fed.

Here, there is a characteristic that, when the air flow volume of the separating fan 31 is constant, the thickness of an air layer between sheets is changed according to sheet types (basis weight) That is, a distance between floating sheets is different between the thin paper and the thick one because a light sheet, like thin paper, with a small basis weight is easily floated, and a heavy sheet, like thick paper, with a large basis weight is hardly floated.

More particularly, according to a configuration in which sheets in the upper portion, among the sheet stack on the tray 12, are floated by blowing air, and an air layer is made between sheets, the air layer (distance between sheets) depends on a sheet type, for example, the air layer becomes thick in the case of light paper like thin paper, and the air layer becomes thin in the case of heavy paper like thick paper. Accordingly, a position of a sheet at the uppermost level in the height direction depends on a sheet type when sheets are floated by blowing air. For example, the position of thin paper becomes higher, and that of thick paper is moved downward. Then, the tray 12 is moved downward in such a way that a sheet at the uppermost level is located at a feed position between the lower limit sensor 203 and the upper limit sensor 204, wherein the sheet may be fed at the feed position. Then, a sheet type may be discriminated, based on a moving amount ΔL1 at a time when the tray 12 is moved downward. That is, a larger basis weight of a sheet causes a moving amount of a sheet at the uppermost level to become smaller.

Figure 12:
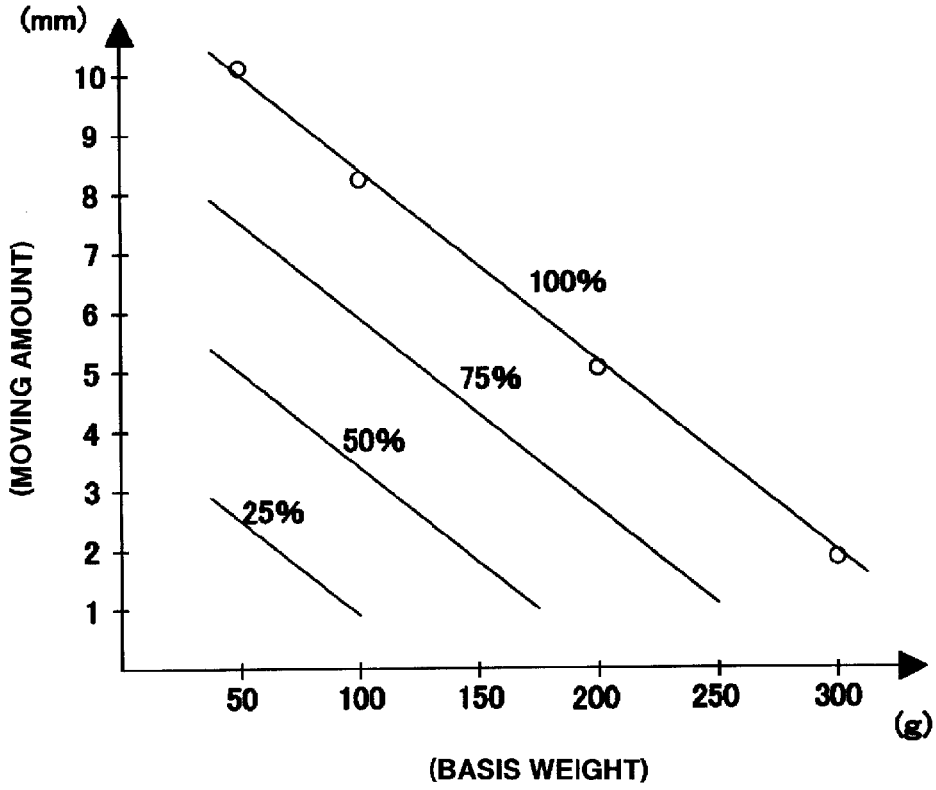
FIG. 12 is a view illustrating a characteristic diagram of a basis weight and a moving amount, assuming that a drive PWM of a separating fan is set as a parameter.

FIG. 12 illustrates results of experiments in which sheet types have been discriminated according to the method. Driving of the separating fan 31 is controlled by pulse width modulation (PWM) control. FIG. 12 is a graph illustrating a moving amount of the tray 12 in the storage 11 according to the basis weight of the sheet, assuming that the drive PWM of the separating fan 31 is set as a parameter. A table made by use of FIG. 12 is a table of "Tray Moving Amounts for Each of Separating Fan Drive PWMs" illustrated in FIG. 13.

In FIG. 12, moving amounts of the tray 12 are different, depending on the sheet types, as understood from the results illustrated in FIG. 13, when the separating fan 31 is driven at a predetermined PWM. Accordingly, a sheet type of a sheet may be discriminated, based on the moving amount of the tray 12.

In the present embodiment, four types of sheets from thin paper to the thickest paper are detected, using a table in which the drive PWM of the separating fan is 100% in FIG. 13. For example, when the moving amount of the tray 12 is 8 mm, the stacked sheet is "plain paper", and, in the case of 5 mm, the stacked sheet is "thick paper".

Here, it is not illustrated in the drawing, but it is understood that the characteristics is changed by the environments with regard to relations between the basis weight and the moving amount of the tray. Temperatures and humidities are detected by use of not-illustrated environmental sensors, and the optimum movement of the tray 12 is calculated from detection results, using a table (a table corresponding to FIG. 13). That is, as a sheet absorbs moisture and becomes heavy at a high humidity, an amount of moisture is measured in experiments and the like beforehand, and a table is made, considering the measured results. Then, the optimum movement is calculated, using the table. Though the sheet type is discriminated, based on the moving amount of the tray 12, in the present embodiment, there may be another configuration in which moving time is measured, and a sheet type is discriminated, based on the measured time, if the speed of the tray moving motor 201 is constant.

Figure 14:
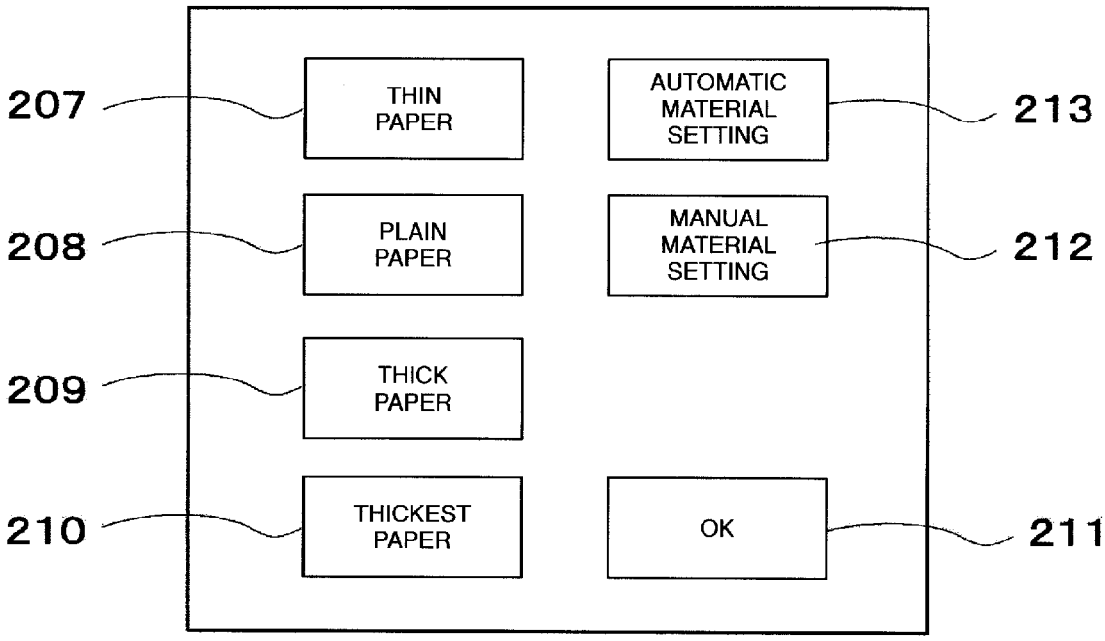
FIG. 14 is a view describing a sheet type input screen.
Figure 15:
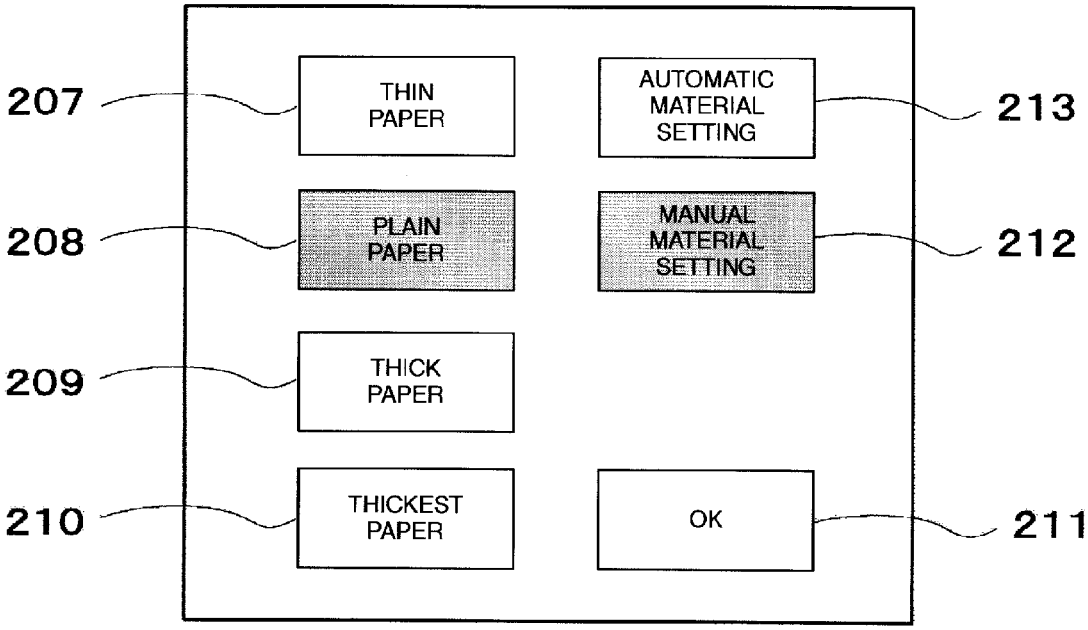
FIG. 15 is a view describing a sheet type input screen.

Then, input of a sheet type, and the drive PWM of the separating fan 31 at the input will be described. When, in the first place, a user draws out the storage 11, sets sheets, and stores the storage 11 at a predetermined position again, the tray 12 is driven by the tray moving motor 201 through the pulley 202, and is moved upward and stopped at a predetermined position. After the tray 12 stops at the predetermined position, a sheet type input screen illustrated in FIG. 14 is displayed on the operation portion 500A. Buttons 207 through 210 corresponding to a sheet type such as "thin paper", "plain paper", "thick paper", and "thickest paper", and buttons 212 and 213 are provided on the sheet type input screen forming a sheet type input portion, wherein it is selected, using the buttons 212 and 213, whether a material (sheet type) is automatically, or manually set. Then, after a user selects a manual sheet-material setting 212 on the sheet type input screen as illustrated in FIG. 15, the user selects and pushes a button indicating a sheet type corresponding to the material of a sheet set on the tray 12, and, thereafter, an OK button 211 is pushed.

In the present embodiment, in order to secure the optimum separation and conveying of sheets, the separating fan drive PWM is assumed to be 25% for thin paper, 50% for plain paper, 75% for thick paper, and 100% for the thickest paper.

Figure 16:
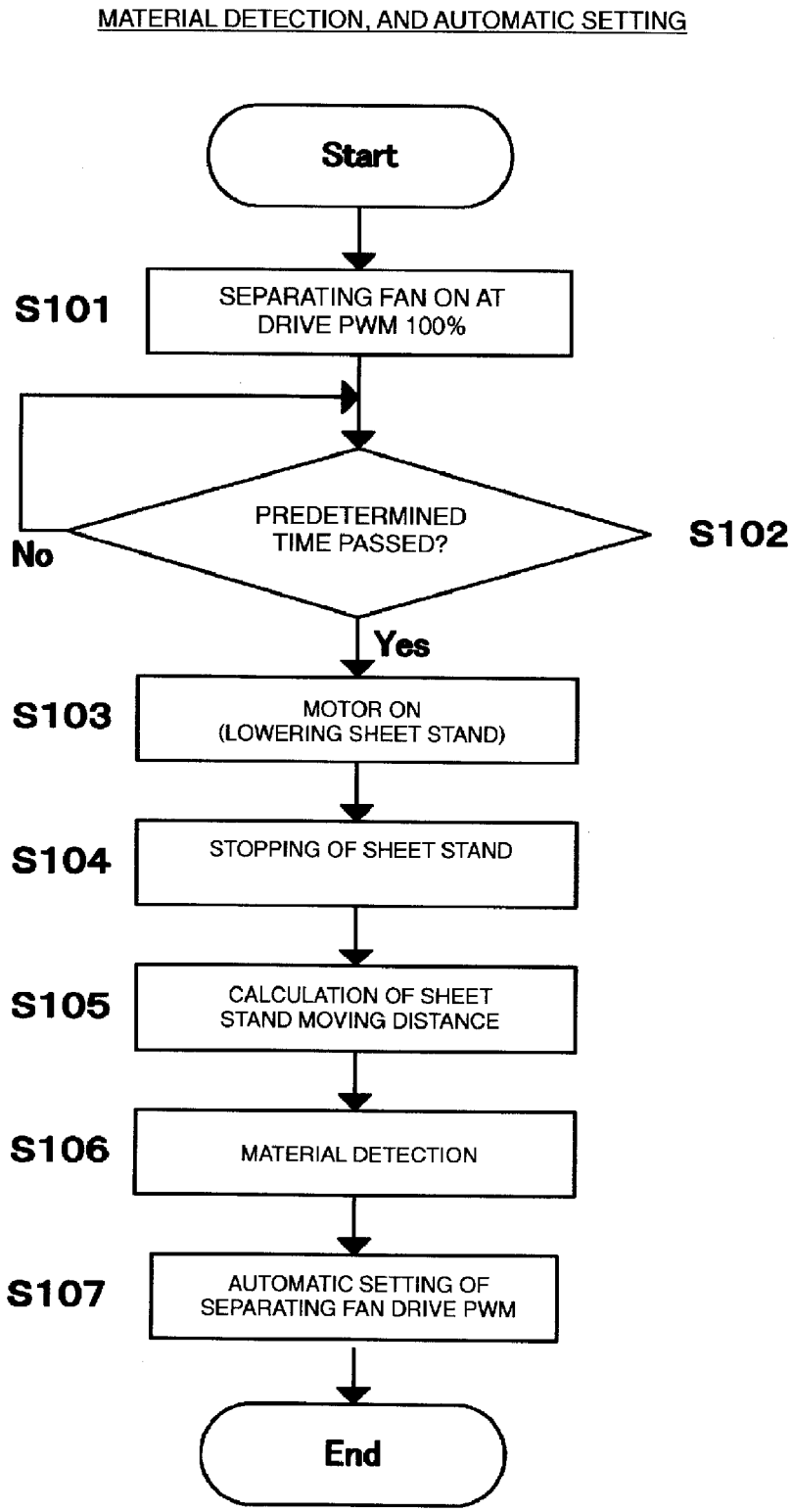
FIG. 16 is a flow diagram illustrating a procedure according to which a sheet type is detected, and is automatically set.

Subsequently, a procedure will be described, referring to a flow diagram illustrated in FIG. 16, wherein, according to the procedure, a sheet type is detected, and the optimum control of the separating fan 31 is set at preliminary loosening before sheet feeding. Here, the preliminary loosening is executed in order to secure separate-feeding of sheets after sheet feed operation is started, wherein, according to the preliminary loosening, a sheet stack is loosened beforehand after sheets are stacked in the storage 11 before receiving a sheet feed signal.

Figure 17:
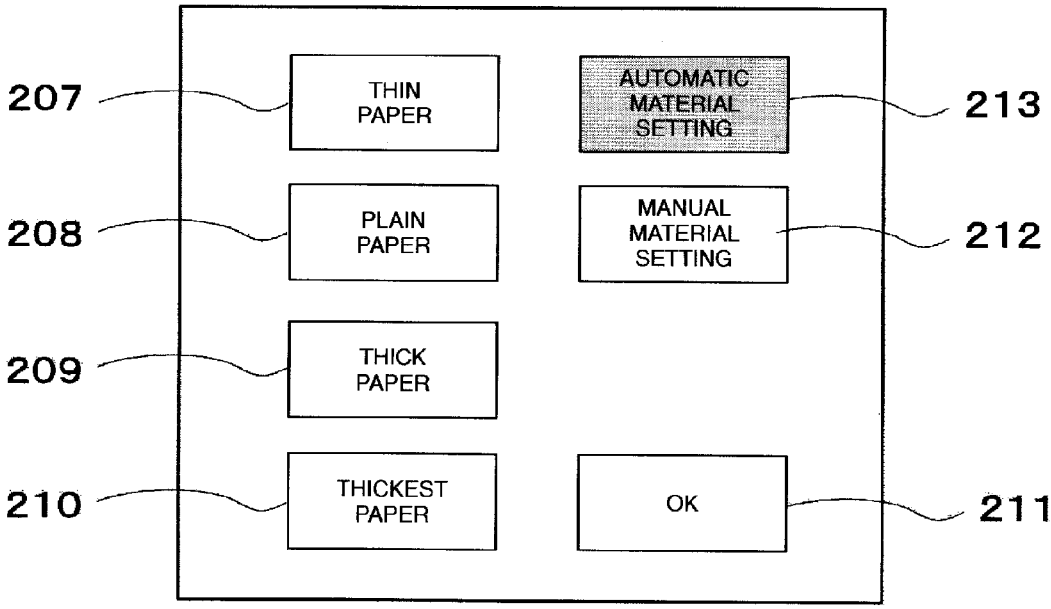
FIG. 17 is a view describing a sheet type input screen.

As described above, a sheet material input screen illustrated in FIG. 14 is displayed on the operation portion 500A when the tray 12 stops at the predetermined position after a sheet stack is set in the tray 12. A user selects automatic material setting 213 on the sheet type input screen as illustrated in FIG. 17, and pushes the OK button 211.

Subsequently, the separating fan 31 is driven at a drive PWM of 100% (S101). Subsequently, the CPU 401 judges (S102) whether predetermined time, after which the rotation number of a fan becomes constant, has passed after driving the separating fan 31, and the tray moving motor 201 is driven (the tray 12 is moved downward: S103) after the predetermined time has passed. Thereafter, when the CPU 401 detects that the sheet at the uppermost level is in a state in which the sheet may be fed (detect that the sheet at the uppermost level is at a feed possible position), the tray 12 stops (S104).

Subsequently, a sheet type (material) of a sheet stored in the storage 11 is detected (S106) by comparison between the moving amount of the tray 12, which is calculated by the CPU 401 (S105), and a basis weight-moving amount table stored in the ROM 402. Then, the CPU 401 automatically sets (S107) an optimum separating fan drive PWM suitable for the detected sheet type.

Figure 18:
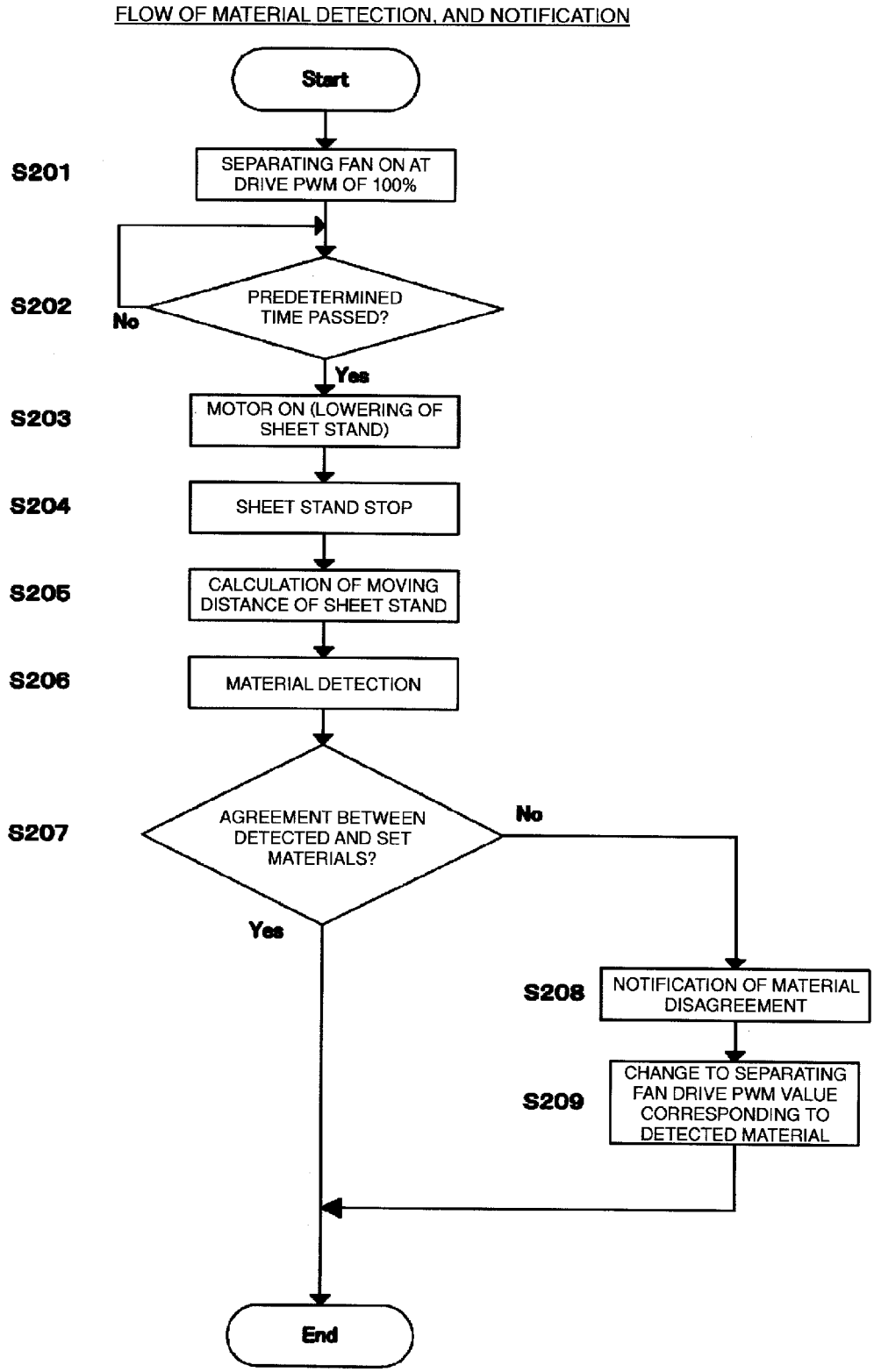
FIG. 18 is a flow diagram illustrating a procedure according to which a sheet type is detected, and, when the type is different from the set type, the fact is notified.

Subsequently, when a sheet type is detected at preliminary loosening, and the detected type and the actually set type are not in agreement with each other, the disagreement is notified. A procedure according to which setting is automatically changed will be described, referring to a flow diagram illustrated in FIG. 18.

When a user draws out the storage 11, sets sheets, and stores the storage 11 at a predetermined position again in the first place, by driving the tray moving motor 201 through the pulley 202 the tray 12 is moved upward and stops at a predetermined position. After the tray 12 stops at the predetermined position, the sheet type input screen illustrated in FIG. 14 is displayed on the operation portion 500A. After a user selects a manual sheet-material setting 212 on the sheet type input screen, the user selects and pushes a button indicating a sheet type corresponding to the material of a sheet set on the tray 12, and, thereafter, an OK button 211 is pushed.

Subsequently, the separating fan 31 is driven at a drive PWM of 100% (S201). Then, the CPU 401 judges (S202) whether predetermined time, after which the rotation number of a fan becomes constant, has passed after driving the separating fan 31, and the tray moving motor 201 is driven after the predetermined time has passed (S203 the tray 12 is moved downward).

Thereafter, if the CPU 401 detects that a sheet at the uppermost level is in a state that the sheet may be fed, the tray 12 is stopped (S204). Subsequently, a sheet type of a sheet stored in the storage 11 is detected (S206) by comparison between the moving amount calculated by the CPU 401 (S205), and a basis weight-moving amount table stored in the ROM 402.

Figure 19:
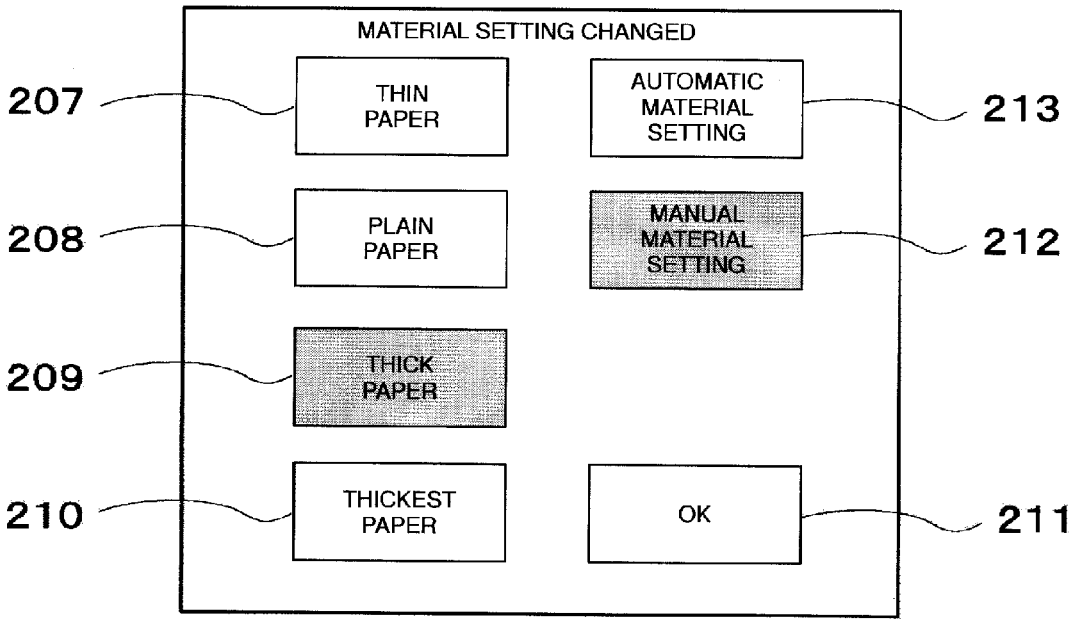
FIG. 19 is a view describing a sheet type input screen.

Then, the CPU 401 as a comparison portion comparing sheet types judges (207) whether the detected sheet type and the sheet type set by a user through the display portion 501 in the operation portion 500A are the same with each other. When they are different from each other, the comparison result is displayed (S208) on the display portion 501. Thereafter, setting is changed (S209) to a separating fan drive PWM value corresponding to the detected sheet type as illustrated in FIG. 19.

Here, preliminary loosening described above is performed just after a sheet is set in the tray 12, but loosening is acceptably performed just before a sheet is fed at real copying.

Various types of sheets may be reliably separated and supplied to the image forming portion by the control. Moreover, good-quality image forming may be performed by properly adjusting a transfer voltage in the transfer portion, and a fixing temperature in the fixing portion according to the detected sheet type.

Here, according to the embodiment, control for moving downward the tray 12 is performed, and the sheet type is detected, based on the movein amount of the tray 12 after air is blown, and a sheet at the uppermost level is configured to be blown up beyond a detection range (feed position) defined by the lower limit sensor 203 and the upper limit sensor 204. However, the present invention is not limited to the configuration, and there is another configuration in which air is blown, the tray 12 is controlled to be moved upward in such a way that a sheet at the uppermost level does not reach within a detection range (feed position) defined by the lower limit sensor 203 and the upper limit sensor 204, and, based on the moved amount of the tray 12, the sheet type is acceptably detected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-029893, filed Feb. 9, 2007, which is hereby incorporated by reference herein in its entirety.

What is claimed is:

1. A sheet feeding device, comprising:

a tray which may be moved upward and downward in a state in which a plurality of sheets are stacked;

an air blowing unit which blows air onto a sheet stacked in the tray for floating and loosening;

an absorption conveying unit which absorbs and conveys a uppermost sheet of the sheets stacked on the tray floated by blowing air blown by the air blowing unit at a feed position;

a sheet detection portion which detects a position of the uppermost sheet floated by blowing of the air blowing unit;

a tray moving unit which moves the tray upward and downward;

a tray moving amount detection portion which detects a tray moving amount caused by the tray moving unit;

a sheet kind input portion through which the sheet kind is input; and a comparison portion which performs a comparison between the sheet kind input through the sheet kind input portion, and the sheet kind which is discriminated on the basis of detection by the tray moving amount detection portion, wherein the tray is moved by the tray moving unit in such a way that the uppermost sheet floated by blowing air is moved to the feed position based on detection of the sheet detection portion, and a sheet kind of the sheets on the tray is discriminated based on the moving amount of the tray detected by the tray moving amount detection portion, and a comparison result made by the comparison portion is notified when the sheet kind input by the sheet kind input portion and the sheet kind discriminated based on the detection of the tray moving amount detection portion are different from each other in the comparison result.

2. The sheet feeding device as claimed in claim 1, wherein an air blowing amount blown by the air blowing unit is changed according to the sheet kind discriminated on the basis of a moving amount detected by the tray moving amount detection portion.

3. The sheet feeding device as claimed in claim 1, wherein, when the sheet kind input by the sheet kind input portion and the sheet kind discriminated based on the detection of the tray moving amount detection portion are different from each other in a comparison result made by the comparison portion, the comparison result is notified, and the air blowing amount of the air blowing unit is changed according to the sheet kind discriminated based on the detection of the tray moving amount detection portion.

4. An image forming device comprising;

a tray which may be moved upward and downward in a state in which a plurality of sheets are stacked;

an air blowing unit which blows air onto a sheet stacked in the tray for floating and loosening;

an absorption conveying unit which absorbs and conveys a uppermost sheet of the sheets stacked on the tray floated by blowing air blown by the air blowing unit at a feed position;

a sheet detection portion which detects a position of the uppermost sheet floated by blowing of the air blowing unit;

a tray moving unit which moves the tray upward and downward;

a tray moving amount detection portion which detects a tray moving amount caused by the tray moving unit;

a sheet kind input portion through which the sheet kind is input;

a comparison portion which performs a comparison between the sheet kind input through the sheet kind input portion, and the sheet kind which is discriminated on the basis of detection by the tray moving amount detection portion; and an image forming portion forming an image on a sheet fed by the absorption conveying unit, wherein the tray is moved by the tray moving unit in such a way that the uppermost sheet floated by blowing air is moved to the feed position based on detection of the sheet detection portion, a sheet kind of the sheets on the tray is discriminated based on the moving amount of the tray detected by the tray moving amount detection portion, and a comparison result made by the comparison portion is notified when the sheet kind input by the sheet kind input portion and the sheet kind discriminated based on the detection of the tray moving amount detection portion are different from each other in the comparison result.

5. The image forming device as claimed in claim 4, wherein an air blowing amount blown by the air blowing unit is changed according to the sheet kind discriminated on the basis of a moving amount detected by the tray moving amount detection portion.

6. The image forming device as claimed in claim 4, wherein, when the sheet kind input by the sheet kind input portion and the sheet kind discriminated based on the detection of the tray moving amount detection portion are different from each other in a comparison result made by the comparison portion, the comparison result is notified, and the air blowing amount of the air blowing unit is changed according to the sheet kind discriminated based on the detection of the tray moving amount detection portion.

* * * * *